US005791968A

United States Patent [19]

Matsumura et al.

[11] Patent Number: 5,791,968

[45] Date of Patent: *Aug. 11, 1998

[54] GRINDING METHOD AND GRINDING SYSTEM FOR STEELS

[75] Inventors: Hiroyuki Matsumura; Yoshikazu Ikemoto, both of Kobe; Keiji Tsujita, Akashi; Hidetaka Tanaka, Himeji; Kazumi Daitoku, Kitakyushu; Tomoharu Shimokasa, Kitakyushu; Fujiya Nogami, Kitakyushu; Kenji Minami, Kitakyushu, all of Japan

[73] Assignees: Kawasaki Jukogyo Kabushiki Kaisha, Kobe; Nippon Steel Corporation, Tokyo, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 711,708

[22] Filed: Aug. 30, 1996

Related U.S. Application Data

[63] Continuation of Ser. No. 193,180, filed as PCT/JP93/00218, Feb. 23, 1993, published as WO94/08754, Apr. 28, 1994, abandoned.

[30] Foreign Application Priority Data

Oct. 21, 1992 [JP] Japan ..... 4-283319

[51] Int. Cl.[6] ..... B24B 49/00; B24B 51/00

[52] U.S. Cl. ..... 451/5; 451/40

[58] Field of Search ..... 451/75, 87, 88, 451/89, 90, 99, 102, 36, 38, 39, 40, 5, 8, 9, 10, 11

[56] References Cited

U.S. PATENT DOCUMENTS

| | | | |
|---|---|---|---|
| 4,380,138 | 4/1983 | Hofer | 451/40 |
| 4,601,762 | 7/1986 | Pirlet . | |
| 4,633,620 | 1/1987 | Lorenzi et al. | 451/26 |
| 4,733,503 | 3/1988 | Garlant et al. | 451/75 |
| 4,872,293 | 10/1989 | Yasukawa et al. . | |
| 4,872,975 | 10/1989 | Benson | 451/87 |
| 4,937,985 | 7/1990 | Boers et al. | 451/75 |
| 4,945,688 | 8/1990 | Yie | 451/102 |
| 5,117,366 | 5/1992 | Stong | 364/474 |
| 5,155,946 | 10/1992 | Domann | 451/75 |
| 5,320,289 | 6/1994 | Hashish et al. | 451/102 |

FOREIGN PATENT DOCUMENTS

| | | |
|---|---|---|
| 0488846 | 6/1992 | European Pat. Off. . |
| 48-46993 | 7/1973 | Japan . |
| 50-49125 | 5/1975 | Japan . |
| 51-81684 | 7/1976 | Japan . |
| 51-95938 | 8/1976 | Japan . |
| 51-97894 | 8/1976 | Japan . |

(List continued on next page.)

OTHER PUBLICATIONS

Patent Abstracts of Japan, vol. 7, No. 221 (M-246) [1366], Sep. 30, 1983, M. Sadayuki, "Controlling Method . . . Machine".

Manufacturing Review, vol. 2, No. 2, Jun. 1989, M. Hashish, "Machining of Advanced . . . Abrasive Waterjets", pp. 142–150.

*Primary Examiner*—Timothy V. Eley
*Assistant Examiner*—Derris H. Banks
*Attorney, Agent, or Firm*—Leydig, Voit & Mayer, Ltd.

[57] ABSTRACT

A grinding method is provided in which abrasive is projected onto a steel product through a nozzle to perform grinding thereon such as in a continuous casting process or in a subsequent process, wherein high-pressure water jet mixed with the abrasive is projected onto the surface of the steel product to grind defects on the surface, etc. thereof. A grinding system for executing this grinding method is also provided, the system including supply sources of high-pressure liquid and abrasive, a nozzle device connected with these supply sources, an abrasive recovery device for recovering the used abrasive as needed and restoring the same to the supply sources, and combined detection systems.

7 Claims, 7 Drawing Sheets

FOREIGN PATENT DOCUMENTS

| | | | |
|---|---|---|---|
| 51-137191 | 11/1976 | Japan . | |
| 51-145432 | 12/1976 | Japan . | |
| 52-5644 | 1/1977 | Japan . | |
| 52-81048 | 7/1977 | Japan . | |
| 53-132434 | 11/1978 | Japan . | |
| 55-18570 | 5/1980 | Japan . | |
| 56-51069 | 12/1981 | Japan . | |
| 63-56904 | 4/1988 | Japan . | |
| 1530167 | 12/1989 | U.S.S.R. | 451/75 |
| 2159451 | 12/1985 | United Kingdom . | |

GRINDING METHOD AND GRINDING SYSTEM FOR STEELS

This disclosure is a continuation of patent application Ser. No. 08/193,180, filed as PCT/JP93/00218 Feb. 23, 1993, published as WO94/08754 Apr. 28, 1994 now abandoned.

TECHNICAL FIELD

The present invention relates to material surface grinding and, in particular, to a grinding method and system for grinding defective surface portions of steel products such as slabs, blooms and billets in continuous casting lines or ingot casting lines or the like and after-processes following the same.

BACKGROUND ART

Steel products such as blooms, slabs and billets, formed by continuous casting or ingot casting processes, may develop various defects during their casting. Such defects will lead to a reduction in product yield and a deterioration in product quality in after-processes following the casting.

To cope with this problem, such defects are removed by reconditioning during or after the production of steel products such as slabs, blooms or billets, so that only steel products from which all defects have been removed are fed to the after-processes, thereby preventing a reduction in product yield and a deterioration in product quality.

Generally adopted means for reconditioning steel products are flame scarfing using a hot scarfer and grinding using a grinder. An example of the flame scarfing method is shown in Japanese Patent Laid-Open No. 52-5644, according to which a gantry frame is arranged to have two supporting beams, on which two movable nozzle operation units for side and upper surface are mounted, respectively. Another example of the flame scarfing method is shown in Japanese Patent Laid-Open No. 52-81048, according to which flame scarfing is performed by using a plurality of transversely arranged torches, making it possible to remove extensive defects without performing auxiliary flame scarfing in transverse direction at the beginning.

Regarding grinding using a grinder, an example thereof is shown in Japanese Patent Laid-Open No. 48-46993, according to which billets, etc. are ground by using an abrasive wheel whose grinding performance is improved by employing a hydraulic or pneumatic cylinder. Another example of the grinding method is shown in Japanese Patent Laid-Open No. 1-242729, according to which cast stainless steels or other stainless steel products are reconditioned to effectively remove any defective portions therefrom in a specific temperature range, thereby avoiding the problem of the self-hardening property of stainless steels.

Apart from the above-described methods of removing defects through reconditioning by flame scarfing or grinding, various other reconditioning methods have been proposed which are mainly directed to descaling during the production of steel products. For example, Japanese Patent Laid-Open No. 51-97894 discloses a method according to which a predetermined type of abrasive is sprayed through nozzles onto the surface of a stainless steel plate to effect wet grinding and descaling at the same time.

However, as will be discussed below, the above-described steel product reconditioning methods have various problems.

Both the flame scarfing method disclosed in Japanese Patent Laid-Open No. 52-5644, in which a gantry frame is arranged to have two supporting beams, on which two movable nozzle operation units for side and upper surfaces are mounted, respectively, and the method disclosed in Japanese Patent Laid-Open No. 52-81048, in which flame scarfing is performed by using a plurality of transversely arranged torches to make it possible to effect flame scarfing on extensive defects without performing auxiliary flame scarfing, have a problem in that the flame scarfing operation itself involves a high temperature and a large amount of dust, causing a deterioration in working conditions. Moreover, with these methods, it is difficult to discriminate any defects remaining on the surface of the steel products after flame scarfing.

Further, in flame scarfing, it is impossible to control the scarfing depth, creating an unevenness. Thus, some defects remain, but to prevent defects from remaining, the flame scarfing amount is increased, resulting in a reduction in yield.

Another problem with flame scarfing, compared with other types of methods, is that it requires equipment on a larger scale for automatizing the process to achieve an improvement in working conditions and operational efficiency, resulting in high costs.

Regarding grinding methods using a grinder, e.g., the above-described method disclosed in Japanese Patent Laid-Open No. 48-46993, in which billets, etc. are ground by using an abrasive wheel whose grinding performance is improved by employing a hydraulic or a pneumatic cylinder, and the method disclosed in Japanese Patent Laid-Open No. 1-24729, in which steel reconditioning by a grinder is performed on cast stainless steels or other other stainless steels in a specific temperature range; these methods involve, like the above-described flame scarfing methods, an operation under unfavorable conditions of high temperature and a large amount of dust depending upon the steel type. Moreover, as in the above-described flame scarfing methods, it is difficult to discriminate any defects remaining on the steel surface after grinding, resulting in high defect-removal costs, etc.

Enlarging the grinder width results in a large amount of steel being unnecessarily ground and requires a large driving power, which leads to an increase in running costs and a reduction in yield. On the other hand, reducing the grinder width results in a deterioration in efficiency because a large number of grinders are required, with the reconditioning time undesirably increased. The steel defect removal method such as disclosed in Japanese Patent Laid-Open No. 51-97894, in which wet blasting are performed by spraying an abrasive through nozzles onto the surface of a stainless steel plate, is, at the present level of technology, mainly directed to descaling and, technically, still not sufficiently developed to be adopted in removing defects from steel products. Thus, it cannot be adopted, practically speaking.

The present invention has been made with a view toward solving the problems in the above-described conventional steel reconditioning techniques. It is accordingly an object of the present invention to provide an excellent steel grinding method which makes it possible not only to easily discriminate any defects remaining on the surfaces of steel products after grinding, such discrimination being important when improving working conditions and automating the steel production process, but also to selectively remove defective portions in accordance with the defect. Thus, a reduction in product costs is achieved, an improvement in yield is attained and, further, the product quality can be positively guaranteed, thereby contributing much to those fields of the iron industry.

DISCLOSURE OF THE INVENTION

To achieve the above object, the following technical means are adopted in the grinding method of the present invention: a predetermined abrasive in the form of fine particles, such as garnet sand, silica sand, alumina, iron sand, or cast-iron grit, is mixed with ultra-high-speed water jet to form an ultra-high-speed abrasive water jet which is continuously ejected through a nozzle as jets having a fixed small diameter to impinge with impact upon the surface of steel products such as slabs, thereby automatically removing, without contact of the apparatus, any undesirable defects existing near the surface of such steel products. Further, automatic sensing is performed on the surface and near-surface portions of the steel products before and/or after the grinding so as to search for any defects and to detect the locations, etc. thereof, thereby making it possible to realize a completely automated, unmanned grinding line.

Further, in accordance with the present invention, there is provided a grinding system for grinding the surface of materials such as steel slabs. In the grinding system, conventional wet blasting and liquid honing methods are further developed to realize a system for grinding the surface of materials such as steel slabs using an abrasive water jet with an increased pressure (normally 300 kgf/cm2 or more) and an improved energy density and machining efficiency. The system is formed by combining the following sub-systems as needed: a defect detection system for detecting defects on material surfaces; a grinding control system for transmitting signals regarding grinding conditions controlled on the basis of defect information detected by the defect detection system; an abrasive supply system for supplying abrasive in accordance with signals from the grinding control system; a grinding-nozzle-device system adapted to move relative to the material in accordance with signals from the grinding control system; and an abrasive recovery system for recovering the abrasive used for grinding, and restoring it to the abrasive supply system.

The defect detection system for detecting defects on material surfaces employs a defect detecting device, which may consist of an image processing apparatus based on magnetic particle inspection or ultrasonic flaw detection, or an apparatus using a telecamera.

Grinding using an abrasive water jet employs a non-heating-type method. Therefore, the method does not involve surface-defect obscuration caused by the influence of heat or the melting of material surface portions, so that the detection of defects after machining is easy to perform. Further, since the turning ON/OFF of the machining operation is easy, no ignition error as involved in flame scarfing occurs. In addition, due to the fact that the method adopts a non-contact-type machining means, the method is relatively free from service-life problems as compared with methods using grinding wheels, which makes it possible to easily construct an automated grinding system.

Moreover, when the sub-system for recovering the used abrasive is connected with the sub-system for supplying the abrasive to be mixed with a high-speed fluid jet, an abrasive circulation system is formed when the abrasive water jet is applied to the grinding of an extensive and continuous surface. A continuous operation is also possible when abrasive water jet nozzles, adapted to make a relative movement with respect to a plurality of steel products, are applied to the grinding of a wide material surface.

PREFERABLE EMBODIMENT OF THE INVENTION

Figure 1:
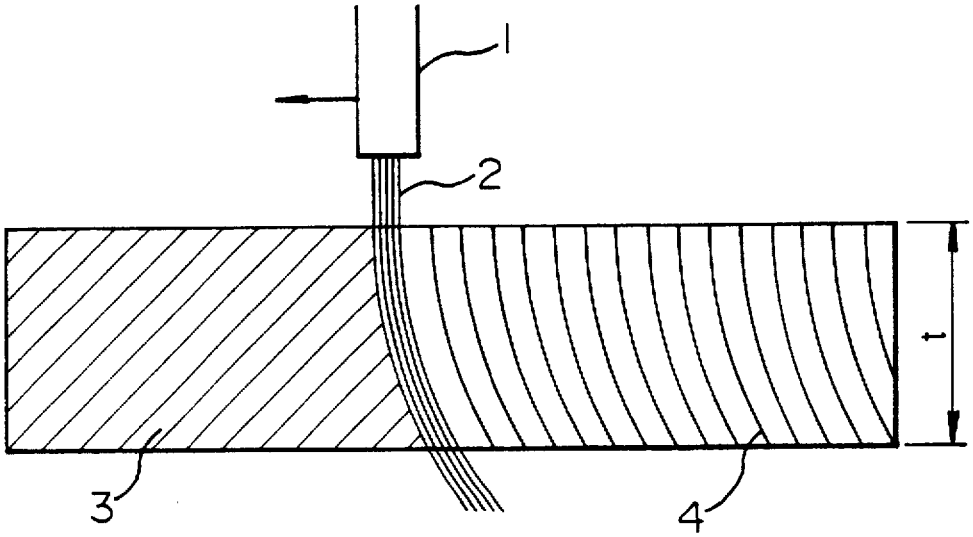
FIG. 1 is a schematic diagram showing how cutting is performed by using an abrasive water jet.
Figure 2:
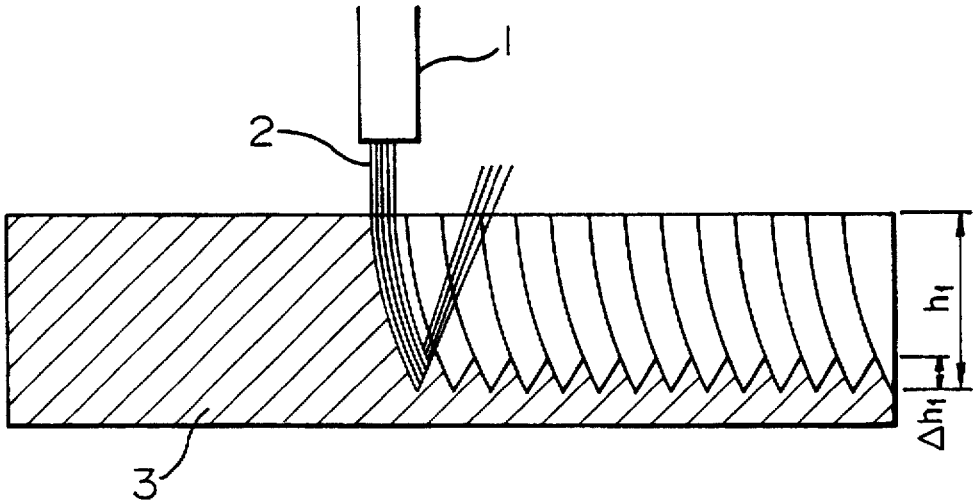
FIG. 2 is a schematic diagram showing how partial cutting is performed by using the abrasive water jet.
Figure 3:
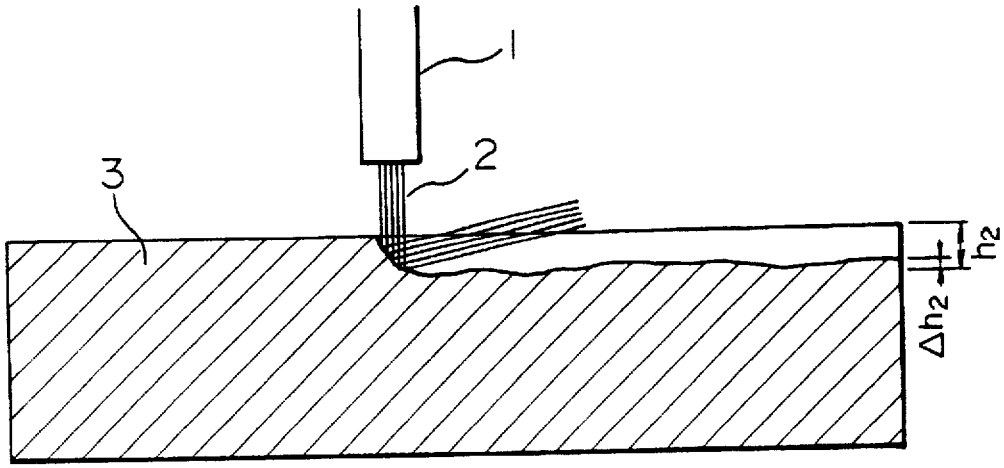
FIG. 3 is a schematic diagram showing how surface grinding is performed by using the abrasive water jet.

FIGS. 1 through 3 are schematic diagrams showing how a cast slab is ground by means of a high-pressure water jet mixed with abrasive (an abrasive water jet). Numeral 1 indicates a nozzle of a so-called abrasive water jet apparatus. A high-pres-sure water jet at a fixed pressure is supplied to a mixing chamber (not shown) and mixed with an abrasive in the form of fine particles, such as garnet sand, silica sand, alumina, iron sand, or cast-iron grit to form a jet 2 having a fixed small diameter, which is expelled at ultra-high speed onto a steel slab 3 to be ground. FIGS. 1 through 3 show how cutting (grinding) is performed when the relative traversing speed of the nozzle 1 with respect to the slab 3 (the nozzle feeding speed or the speed at which the slab 3 is fed) is varied.

FIG. 1 shows normal cutting, in which grinding is performed over the entire thickness t of the slab 3. In this case, the relative traversing speed of the nozzle is in a low-speed range which is low enough to enable the slab 3 to be cut in a satisfactory manner. Drag lines 40 are formed over the thickness t of the slab 3.

FIG. 2 shows a case in which the relative movement of the nozzle 1 and the slab 3 is made at a higher speed than in the case of FIG. 1. Here, the cutting is not effected over the entire thickness t of the slab 3, the cutting depth h1 showing a fluctuation by a difference $\Delta h1$ at the bottom portion formed by the cutting.

In the example of FIG. 3, the relative traversing speed between the nozzle 1 and the slab 3 is even higher than in the example of FIG. 2. The cutting depth h2 in this case is smaller than that in FIG. 2. At the same time, the fluctuation in depth $\Delta h2$ is also smaller than that in FIG. 2, with the result that the bottom surface formed by the cut grooves are practically smooth, thus making it possible to perform the so-called groove grinding.

In the present invention, the above grinding principle and grinding-speed ranges of the abrasive water jet are applied to the grinding of the surface of a steel slab 3.

Further, in the present invention, by adopting the above-described principle, the surface of the steel slab 3 is subjected, though microscopically, to a positive grinding action due to the the eroding effect of the abrasive grains in the ultra-high-speed water jet, thereby making it possible to remove defects under ideal conditions involving no generation of heat.

By the relative feeding of the nozzle 1 forming the above jet spout, it is possible to smooth the entire surface of the steel slab 3 by grinding it uniformly, or partially by selecting defective portions existing on or near the surface.

Further, due to the provision of the sub-system for detecting defects, etc. before and/or after the above-described grinding, it is possible to detect defects, etc. existing on or near the surface of the steel slab 3, and the positions and sizes of such defects. Information on these defects is input and fed back to be utilized in the grinding operation, whereby it is possible to stabilize the process for removing defects on the surface, etc. of steel products and to positively guarantee the quality thereof and, further, to realize a completely automated working process.

Further, since the steel surfaces after grinding are not covered with oxide scales or the like, defect detection after grinding is relatively easy to perform.

Next, an embodiment of the present invention will be described with reference to the drawings from FIG. 4 onwards.

In the following description, the components which are the same as those of FIGS. 1 through 3 will be referred to by the same reference numerals.

Figure 4:
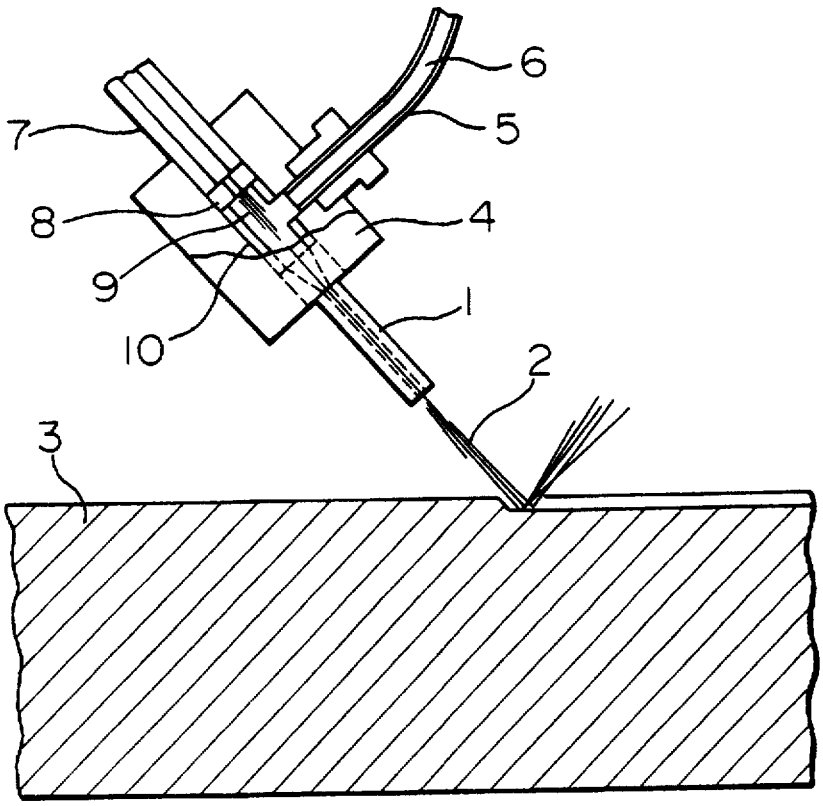
FIG. 4 is a sectional view of an essential part of a grinding system according to the present invention, showing how surface grinding is performed on the surface of a slab by the system.
Figure 5:
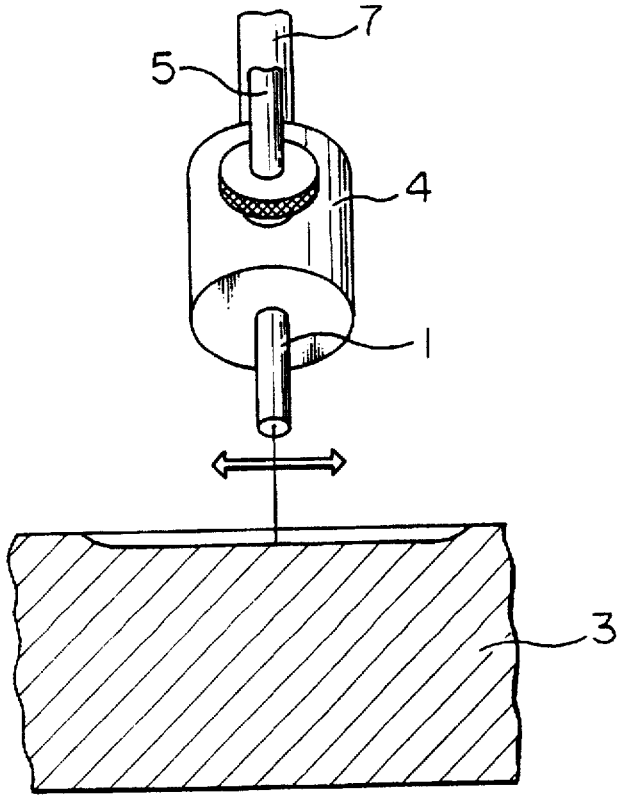
FIG. 5 is a partially sectional front view of the same.

FIGS. 4 and 5 show how the steel slab 3 is ground in accordance with an embodiment of the present invention, along with the construction of a nozzle head 4 of a side entrainment type. Abrasive 6 consisting of garnet sand or the like is supplied to a mixing chamber 10 by a negative pressure due to the venturi effect of an ultra-high-speed water jet 9 generated at a water nozzle 8 connected to a high-pressure water piping 7. The water jet 9 and the abrasive 6 are mixed with each other in the interior of the abrasive nozzle 1, which extends from the mixing chamber 10, accelerated and ejected from the abrasive nozzle 1 onto a predetermined portion of the slab 3 as a jet 2 having a predetermined small diameter to grind the surface of the slab 3 in relative movement, based on the grinding principle described above.

In the above process, the axis of the abrasive nozzle 1 is held at the proper angle with respect to the slab 3 in accordance with the kind of the slab and the type of defect, and the abrasive nozzle is caused to make a relative movement with respect to the slab 3 while swinging or rotating at an appropriate speed and pitch so as to sufficiently cover the defects, etc. on the surface, thereby effecting a desired grinding, etc.

In an experiment, the abrasive was supplied at a speed of 0.5 kg/min or more, and the high-pressure water was supplied at a pressure of 1000 kgf/cm$^2$ or more and a flow rate of 2 lit./min., the working distance between the nozzle and the steel being not more than 200 mm. In this case, the impinging angle with respect to the slab 3 ranged, for example, from 10° to 170°, and the relative speed between the slab 3 and the abrasive nozzle 1 when the abrasive nozzle was swung or rotated was approximately 1 to 10 m/min. Under these conditions, very satisfactory results were obtained. Such conditions, however, differ some-what, depending upon the kind of slab, the type of defect and the kind of abrasive 6, etc.

Figure 6:
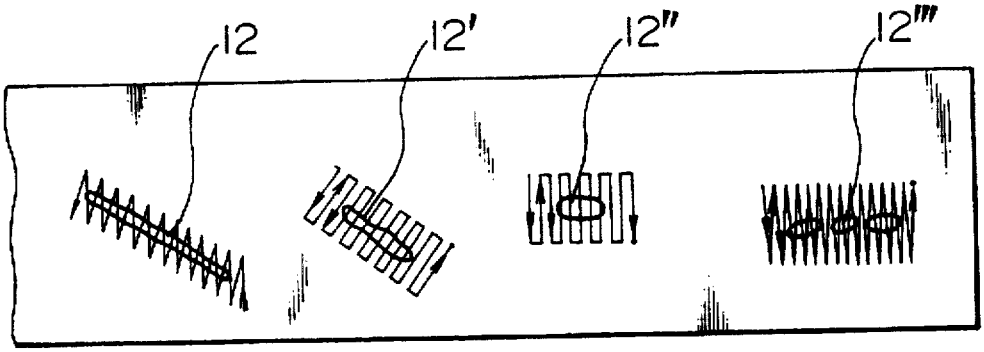
FIG. 6 is a plan view showing defects on the surface of a slab and how a nozzle is moved over them.
Figure 7:
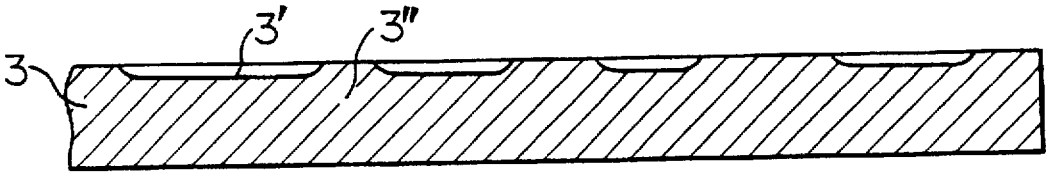
FIG. 7 is a longitudinal sectional view of the same.

FIGS. 6 and 7 show in more detail an example of the way the abrasive nozzle 1 is operated. As shown in the drawings, to cope with defects 12, 12', 12" and 12'", various kinds of swinging modes for the abrasive nozzle 1 can be combined in terms of grinding range, direction and pitch.

In the embodiment shown in FIG. 7, an appropriate rounding is effected in the boundaries between the surface portions 3' where grinding is performed on the defects 12, 12', 12" and 12'" and the surface portions and 3" where no grinding is performed, in order that extremely large differences in thickness may not be generated between these portions.

The abrasive nozzle 1 can also perform grinding as in the above case by a rotation within an appropriate radius, instead of swinging, and pitch feed.

Figure 8:
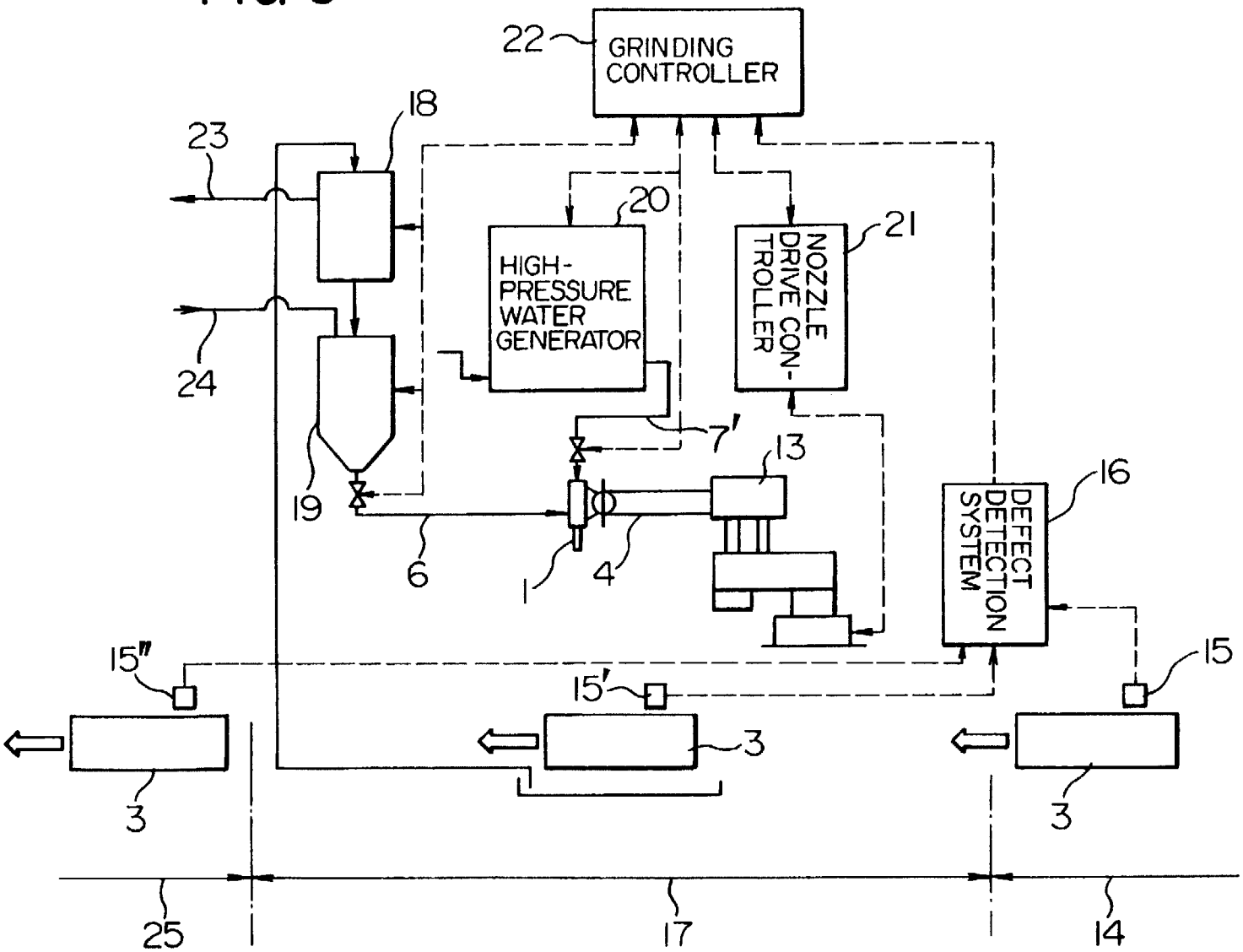
FIG. 8 is a block diagram showing a slab grinding system according to the present invention.

Next, FIG. 8 is a block diagram showing the entire system including an inspection process. In the system shown, an articulated robot is used as a driving device 13 for the abrasive nozzle 1. Searching results obtained at an inspection stage 14 prior to grinding by a defect detecting mechanism 15 consisting of a CCD camera or the like are input to a defect detection system 16 as information on the defects 12, etc. on the slab 3 (in terms of location, size, depth, etc.), grinding being automatically performed in a grinding (scarfing) stage 17 in accordance with the information.

The entire surface of a continuous casting steel product is scanned with a telecamera by a camera driving device which operates in accordance with signals from a camera drive controller in a defect detection system, thereby obtaining defect information in terms of size, configuration, area, depth, etc. The image processing apparatus in the defect detection system performs coordinate transformation on the location of any defect and, on the basis of the coordinates thereby obtained, the location is settled as an address on the steel surface. The information from the image processing apparatus in terms of configuration, depth, grinding range, procedures and location, is input to a collective-control computer in a grinding controller. The input information is supplied to the grinding system to be used as driving instructions for controlling a nozzle drive controller, an abrasive supply system and high-pressure-water generator, etc. to cause the high-pressure fluid nozzle for abrasive water jetting to traverse the steel surface by means of a guide mechanism working on an address basis to perform grinding.

It is possible, as needed, to perform inspection by an optical inspection means during and after the grinding by using the defect detection mechanisms 15' and 15" and the defect detection system 16, utilizing the detection results for feedback during grinding or for re-grinding.

Further, this embodiment adopts a system in which the used abrasive 6 is recovered and supplied to an abrasive feeding device 19 for re-utilization, the fragmental abrasive being separated and removed by a recovery/re-feeding device 18.

Figure 9:
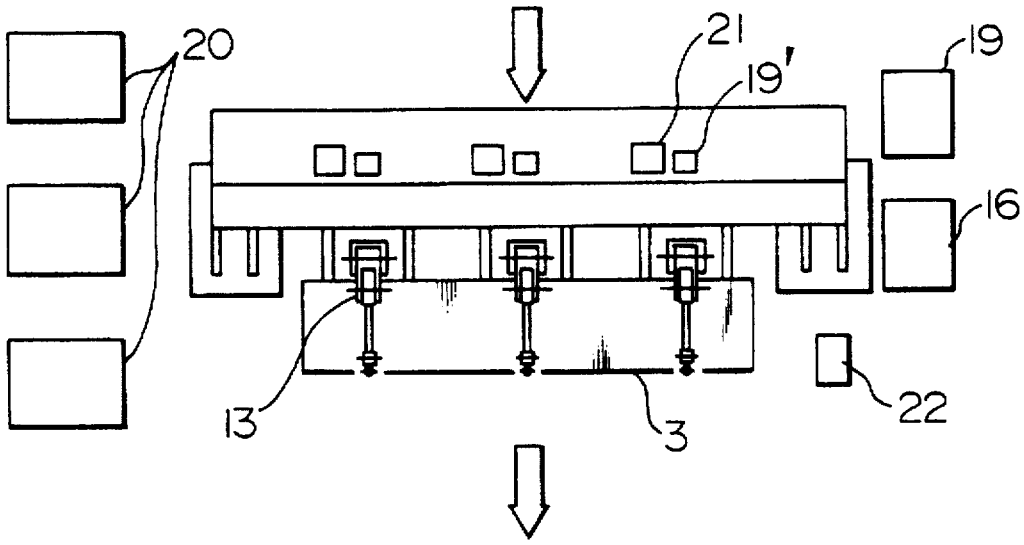
FIG. 9 is a plan view of a slab grinding system according to the present invention.
Figure 10:
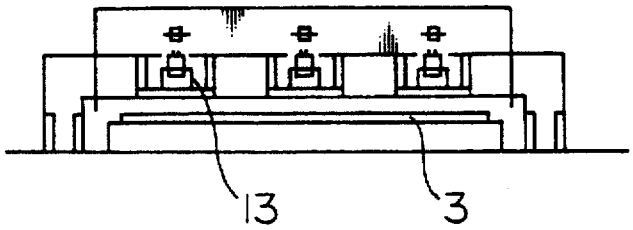
FIG. 10 is a front view of an essential part of the grinding system shown in FIG. 9.
Figure 11:
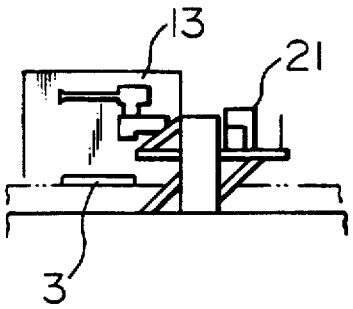
FIG. 11 is a side view of an essential part of the grinding system shown in FIG. 9.

Numeral 20 indicates a high-pressure water generator; numeral 7' indicates a high-pressure water piping; numeral 21 indicates a nozzle drive controller; numeral 22 indicates a grinding controller for overall grinding control; numeral 23 indicates waste abrasive; numeral 24 indicates new abrasive; and numeral 25 indicates an inspection stage. FIGS. 9, 10 and 11 show external views of the entire system of the embodiment shown in FIG. 8, in which three articulated robots cooperate to continuously grind the surface of a steel slab 3 or the like in an average contact time of 7 minutes. The slab 3 is fed in the direction indicated by the arrows.

Next, another embodiment of the present invention will be described with reference to FIGS. 12 through 16.

The system shown in the drawings comprises a defect detection system 101, an abrasive-water-jet-nozzle device 102, a supply system 103 for supplying high-pressure water and abrasive to the nozzles, and a recovery system 104 for recovering the used abrasive and re-feeding the same to the supply system 103.

Information from these systems are input to a grinding controller 105, and the input information is used for controlling the systems by a judgment function of the grinding controller 105.

The slab W to be ground is processed through three stages: inspection stage S1, grinding stage S2 and inspection stage S3. One of the inspection stages S1 and S3 may be omitted.

The defect detection system 101 comprises a defect detection system 111 for detecting defects on the slab surface prior to grinding, a defect detection system 112 for detecting surface defects during grinding, and a defect detection system 113 for detecting defects on the slab surface after grinding for the next process. The surface defect conditions in each of these stages are detected, and information thereon is input to the grinding controller 105, the abrasive nozzle device 102 and the supply system 103 being controlled in accordance with variations in the information.

The abrasive water jet nozzle device 102 comprises a nozzle drive controller 106 controlled by the grinding controller 105, and nozzles 108 driven by a nozzle driver 107.

Figure 12:
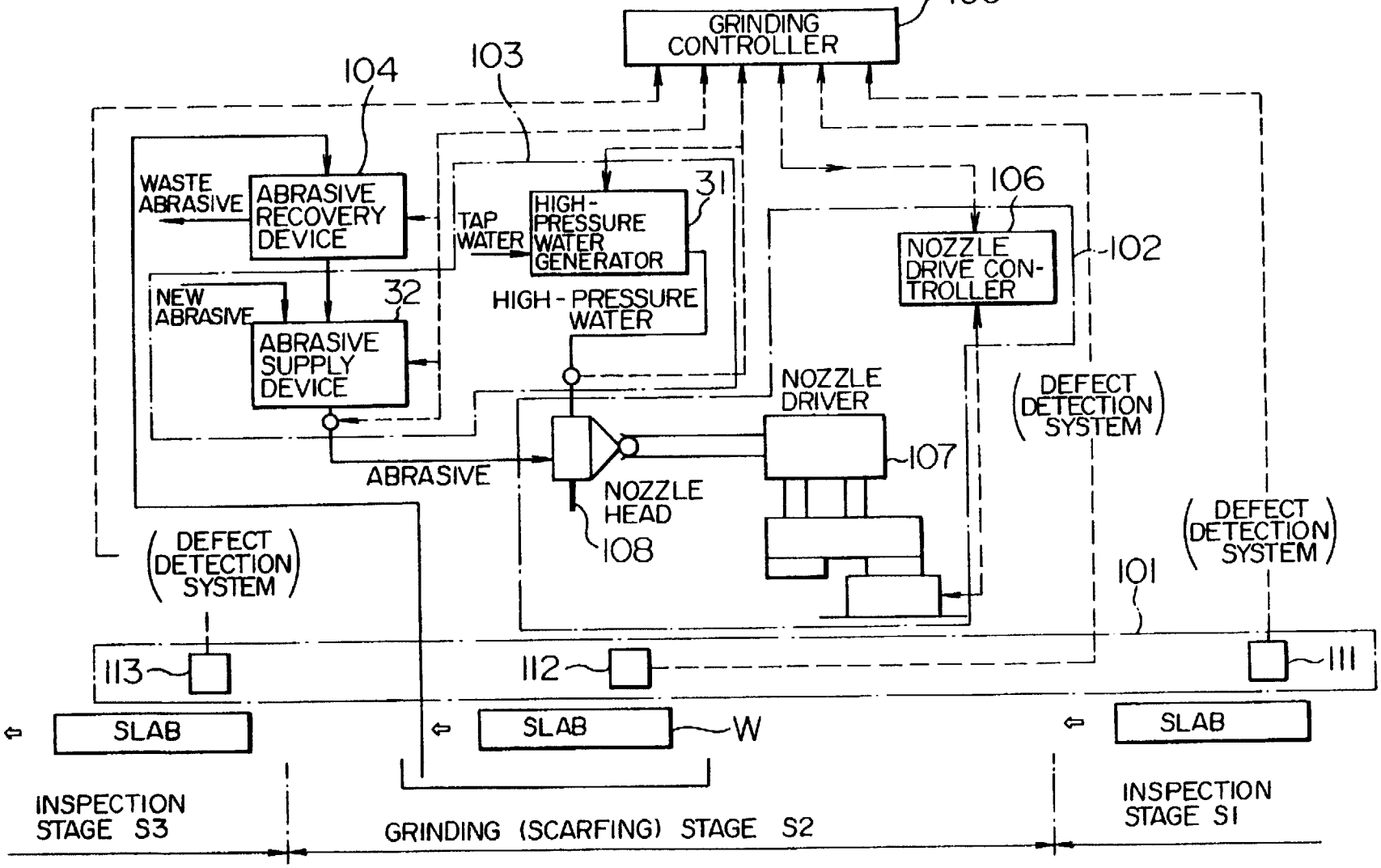
FIG. 12 is a block diagram showing another embodiment of the present invention.
Figure 13:
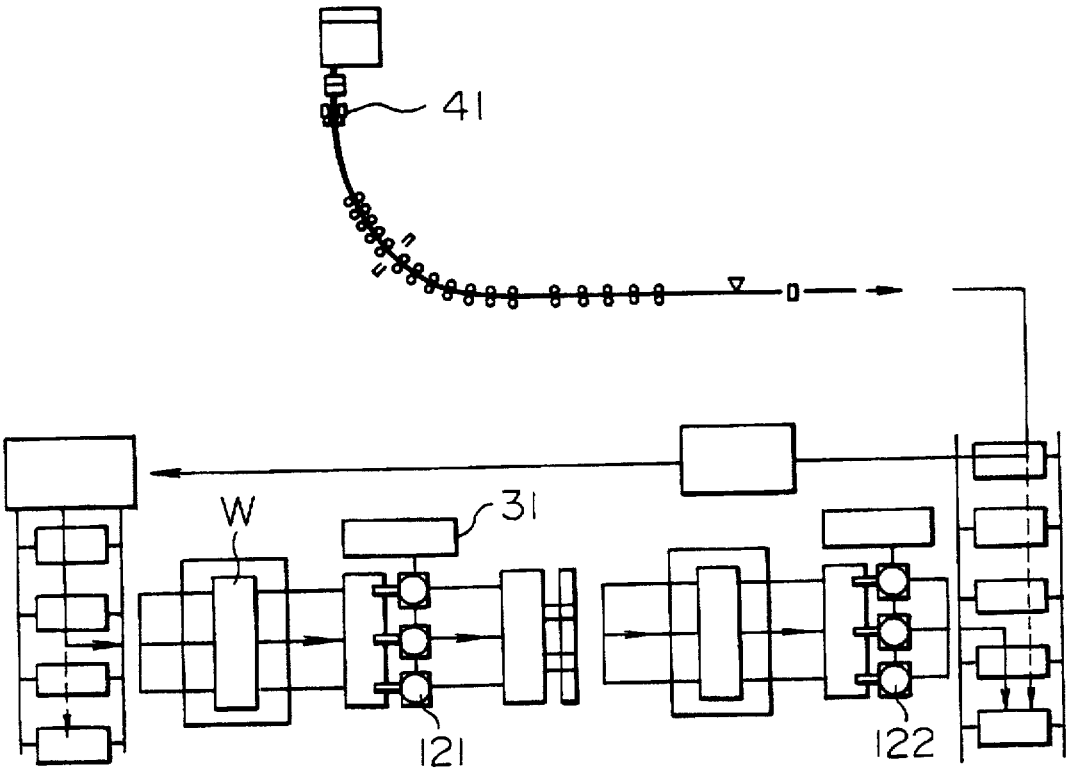
FIG. 13 is a plan view of the embodiment shown in FIG. 12.
Figure 14:
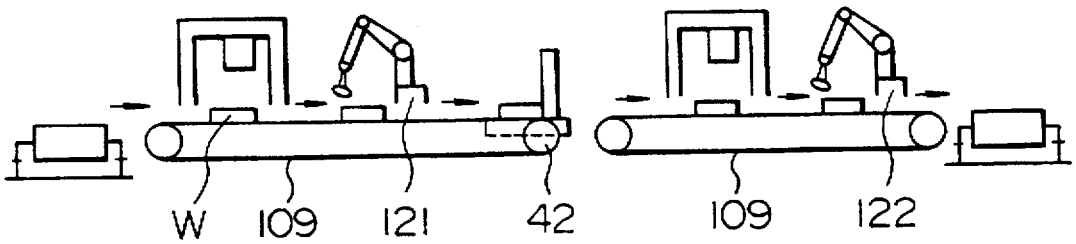
FIG. 14 is a side view of FIG. 13.
Figure 15:
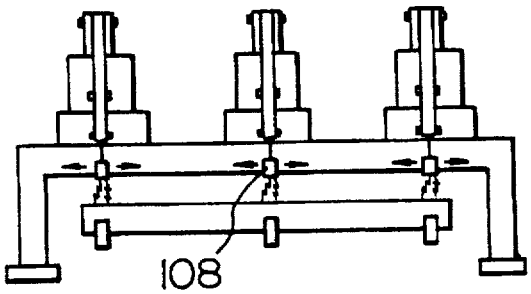
FIG. 15 is front view of an essential part of the embodiment shown in FIG. 13.
Figure 16:
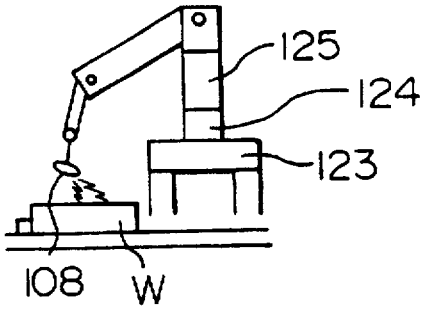
FIG. 16 is a side view of an essential part of FIG. 15.

FIGS. 13 through 16 show a specific system arrangement for the system shown in FIG. 12.

The system shown comprises: a supply system 103 consisting of a high-pressure water generator 31 and an abrasive supply device 32 shown in FIG. 12; and front and rear nozzle devices 121 and 122 for respectively grinding the upper and lower surfaces of slabs, which are reversed by a reversing device 42. Each of the nozzle devices 121 and 122 has three nozzles 108 arranged along the longitudinal dimension of the slabs W produced by a continuous casting machine 41. Each nozzle 108 is attached to the tip of a 6-axis articulated robot 125 provided on a nozzle guide 124 arranged on a base 123 astride a slab moving bed 109. Each nozzle 108 is driven and controlled by the nozzle drive controller 106 and the nozzle driver 107 shown in FIG. 12.

A robot and an NC device can be used as the driving devices for the nozzles 108. One or a plurality of articulated robots may be installed on the floor, ceiling or walls, or in a combination of these installation locations. The driving devices may be stationary or, as in the example shown in the drawings, capable of travelling along one axis or more. The abrasive nozzle head may be of a direct injection type, in which the abrasive and water are mixed at high pressure beforehand and expelled at high pressure through the nozzle in a slurry-like state. Further, the nozzles may be operated so as to move in a variety of rotating and swinging movements.

As described above, in accordance with the present invention, a high-pressure water jet is mixed with abrasive and expelled against steel products, thereby making it possible to perform automatic grinding without contact by a device itself. Thus, conventional defect removal means, such as flame scarfing and wheel grinding, which have been manually performed under severe working conditions involving noise and heat, can be dispensed with, thereby leading to a marked improvement in working conditions (by realizing an unmanned working process, etc.) In addition, the method of the present invention permits the positive removal of any defects existing on or near the surface of a steel product, the removal being effected in a stable manner and to a desired depth-without involving any fusion or deterioration of the material caused by heat. Further, by utilizing the abrasive circulation system as needed, an excellent system can be provided in which it is possible to perform a continuous operation without deteriorating the function of the abrasive water jet itself, which leads to saving of resources and a reduction in cost.

Thus, the present invention provides an excellent machining means for the removal of steel surface detects, which removal has tended to become more and more necessary due to the recent increase in demand for higher quality materials.

We claim:

1. A method for removing surface defect portions on semi-processed steel products including slabs, billets and blooms produced in at least one of a continuous casting stage and stages subsequent to a continuous casting stage, comprising:

(a) detecting surface defect portions on said semi-processed steel products produced in at least one of a continuous casting stage and stages subsequent to said continuous casting stage;

(b) ejecting at least one jet of fine abrasive particles mixed with high-pressure-water onto said surface defect portions in response to detection of said surface defect portions to remove said surface defect portions, said at least one jet of said fine abrasive particles being fed at a rate of not lower than 0.5 Kg/min., and said high-pressure water being supplied at a pressure of not lower than 1000 $Kgf/cm^2$ and at a flow rate of not lower than 2 lit./min., said abrasive particles and high-pressure water being either mixed with each other beforehand in a high-pressure state or mixed within a nozzle head after ejection of the high-pressure water to obtain high-pressure water mixed with abrasive particles, said at least one jet being ejected onto the surface of the steel product to grind the same at a impinging angle of 10° to 170°, and with a working distance between the nozzle and the steel surface of not more than 200 mm; and (c) removing and recirculating the abrasive for reuse in step (b), wherein said abrasive particles are fed at a rate of not lower than 0.5 Kg/min., and said high-pressure water is supplied at a pressure of not lower than 1000 $Kgf/cm^2$ and at a flow rate of not lower than 2 lit./min., said abrasive particles and high-pressure water being either mixed with each other beforehand in a high-pressure state or mixed within a nozzle head after ejection of the high-pressure water to obtain a high-pressure water mixed with abrasive particles, said high-pressure water being ejected onto the surface of the steel product to grind the same at an impinging angle of 10° to 170° and with a working distance between the nozzle and the steel surface of not more than 200 mm.

2. The method according to claim 1 further comprising (d) inspecting surfaces of said steel products produced in at least one of a continuous casting stage and stages subsequent to a continuous casting stage during or after step (b).

3. The method according to claim 1 wherein the step of ejecting at least one jet of fine abrasive particles includes ejecting said jet at a working distance between the nozzle and the steel surface of from 50 to 200 mm.

4. A material surface grinding system for semi-processed steel Products including slabs, billets and blooms produced in at least one of a continuous casting stage and stages subsequent to a continuous casting stage using an abrasive water let, comprising:

(a) a defect detection system including a first detector for detecting defects on a surface prior to grinding;

(b) an abrasive-water-let-nozzle device relatively moving with respect to a material surface;

(c) a supply system for supplying high-pressure-water and abrasive to the abrasive-water-let-nozzle device;

(d) a recovery system for recovering used abrasive and recycling the used abrasive to the supply system; and (e) a grinding controller for receiving information from the defect detection system and controlling the operation of each of the abrasive-water-let-nozzle device, the supply system and the recovery system, wherein the defect detection system further includes at least one of a second detector for detecting defects on a surface during grinding, and a third detector for detecting defects on a surface after grinding.

5. The system of claim 4 wherein the supply system is capable of supplying said high-pressure-water at a pressure of 300 $Kgf/cm^2$ or more.

6. A method for removing surface defect portions on semi-processed steel products including slabs, billets and blooms produced in at least one of a continuous casting stage and stages subsequent to a continuous casting stage, comprising:

(a) detecting surface defect portions on said steel products produced in at least one of a continuous casting stage and stages subsequent to said continuous casting stage;

(b) electing at least one let of fine abrasive particles mixed with high-pressure-water onto said surface defect portions in response to detection of said surface defect portions to remove said surface defect portions; and (c) recovering and recirculating the abrasive for reuse in step (b); and (d) inspecting surfaces of said steel products produced in at least one of a continuous casting stage and stages subsequent to a continuous casting stage during or after step (b).

7. The method of claim 6 further comprising supplying the high-pressure-water at a pressure of 300 $Kgf/cm^2$ or more.

* * * * *

UNITED STATES PATENT AND TRADEMARK OFFICE

CERTIFICATE OF CORRECTION

PATENT NO. : 5,791,968

DATED : August 11,1998

INVENTOR(S) : Matsumura et al.

It is certified that error appears in the above-identified patent and that said Letters Patent is hereby corrected as shown below:

Column 9, Line 6, change "Products" to --products--;

Line 9, change "let" to --jet--;

Line 12 change "abrasive-water-let-nozzle" to --abrasive-water-jet-nozzle--;

Line 15, change "abrasive-water-let-nozzle" to --abrasive-water-jet-nozzle--;

Line 20, change "abrasive-water-let-nozzle" to --abrasive-water-jet-nozzle--;

Column 10, Line 12, change "electing" to --ejecting--

UNITED STATES PATENT AND TRADEMARK OFFICE

CERTIFICATE OF CORRECTION

PATENT NO. : 5,791,968

DATED : August 11, 1998

INVENTOR(S) : Matsumura, et al.

It is certified that error appears in the above-identified patent and that said Letters Patent is hereby corrected as shown below:

Column 10, line 12, change "let" to --jet--.

Signed and Sealed this

First Day of December, 1998

*Attest:*

*Attesting Officer*

BRUCE LEHMAN

*Commissioner of Patents and Trademarks*